US010759211B2

(12) United States Patent
Farneti

(10) Patent No.: US 10,759,211 B2
(45) Date of Patent: Sep. 1, 2020

(54) AUTOMATIC MACHINE AND METHOD FOR COVERING THE COVERS OF BOOKS

(71) Applicant: COLIBRI' SYSTEM S.p.A., Milan (IT)

(72) Inventor: Aldo Farneti, Milan (IT)

(73) Assignee: COLIBRI' SYSTEM S.P.A., Milan (IT)

( * ) Notice: Subject to any disclaimer, the term of this patent is extended or adjusted under 35 U.S.C. 154(b) by 0 days.

(21) Appl. No.: 16/479,621

(22) PCT Filed: Jan. 23, 2018

(86) PCT No.: PCT/IB2018/050405
§ 371 (c)(1),
(2) Date: Jul. 22, 2019

(87) PCT Pub. No.: WO2018/138636
PCT Pub. Date: Aug. 2, 2018

(65) Prior Publication Data

US 2019/0344599 A1 Nov. 14, 2019

(30) Foreign Application Priority Data

Jan. 24, 2017 (IT) ..... 102017000007352

(51) Int. Cl.
*B42C 15/00* (2006.01)
*B42C 7/00* (2006.01)

(52) U.S. Cl.
CPC ..... *B42C 15/00* (2013.01); *B42C 7/006* (2013.01); *B42C 7/008* (2013.01); *B42C 7/009* (2013.01); *B42P 2241/20* (2013.01)

(58) Field of Classification Search
CPC ..... B42C 15/00; B42C 7/006; B42C 7/008; B42C 7/009; B42C 7/00; B42P 2241/20
USPC ..... 412/1, 4, 5, 9, 11, 14, 16, 24
See application file for complete search history.

(56) References Cited

U.S. PATENT DOCUMENTS 3,326,578 A * 6/1967 Fener ..... B42C 15/00 281/34

FOREIGN PATENT DOCUMENTS

| | | |
|---|---|---|
| EP | 0 908 328 A1 | 4/1999 |
| EP | 2 532 526 A1 | 12/2012 |
| JP | 2010-137557 A | 6/2010 |

OTHER PUBLICATIONS

International Search Report, dated Apr. 30, 2018 (10 pages).

* cited by examiner

*Primary Examiner* — Justin V Lewis
(74) *Attorney, Agent, or Firm* — Jacobson Holman, PLLC.

(57) ABSTRACT

An automatic machine for covering the covers of a book of different dimensions starting from a film sheet; the machine comprises a work plane in which the film sheet is arranged, means for welding and cutting the film sheet, first and second means for folding the ends of the film sheet and a control unit adapted to control the welding and cutting means and the first and second folding means as a function of the book dimension for covering the book covers. The machine comprises reception and gripping means configured to receive the book with the open covers at the input position and adapted to grip the body of the book outside the work plane and transport the book to the working position over the film sheet for the operation of covering the book covers.

24 Claims, 21 Drawing Sheets

F7

D4

AUTOMATIC MACHINE AND METHOD FOR COVERING THE COVERS OF BOOKS

BACKGROUND OF THE INVENTION

The present invention relates to an automatic machine for covering books.

Machines for covering the covers of books by means of specific sheets of flexible plastic material, which are supplied in single piece or unwindable from a continuous roll are known.

Some of said machines are of the portable type and are provided with a lower base, which defines a resting surface for the sheet (single or unwindable from a roll) used for the covering the cover of the book, and an upper part movable towards said base starting from a rest position.

The upper part consists of two sides connected by a crosspiece. A space defined between the base and the upper part allows to introduce plastic sheet ends to be welded while the article is positioned against the front of crosspiece.

The crosspiece carries a welding blade which collaborates with a fixed counter-blade restrained to the base and can be warmed by means of an electric resistance fed through the electric circuitry.

A machine for continuously making the covering cover of books is described in patent EP 2532526 and comprises means for cutting a film unwound from a coil to make film sheets, devices for folding the ends of the film sheet, a device adapted to control the folding devices and the cutting devices as a function of the dimensions of the covers; the folding devices comprise rolls arranged so as to make a scheduled passage and a folding blade configured to force the film sheet in the scheduled passage to fold the first end of the film sheet.

However, covering the book covers is rather laborious and complex in said machine.

SUMMARY OF THE INVENTION

It is the object of the present invention to provide an automatic machine for covering books which is simpler and more effective than the known automatic machines.

According to the present invention, such an object is achieved by an automatic machine for covering the covers of a book of different dimensions starting from a film sheet, said machine comprising a work plane on which said film sheet is placed, said machine comprising welding and cutting means of the film sheet, first and second folding means for folding the ends of the film sheet and a control unit adapted to control the welding and cutting means and said first and second folding means as a function of the book dimensions for the covering operation of the book covers, characterized in that it comprises reception and gripping means configured to receive said book with the open covers at the input position and adapted to grip the book body outside the work plane and transport the book to the working position over the film sheet for the covering operation of the book covers, said control unit being adapted to control said reception and gripping means, said control unit being configured to control said first and second folding means to fold the ends of the film sheet on the book covers.

DESCRIPTION OF THE DRAWINGS

The features and advantages of the present invention will become apparent from the following detailed description of a practical embodiment thereof, shown by way of non-limiting example in the accompanying drawings, in which.

DETAILED DESCRIPTION OF THE INVENTION

FIGS. 1 to 16 show an automatic machine for covering books according to an embodiment of the present invention.

Figure 1:
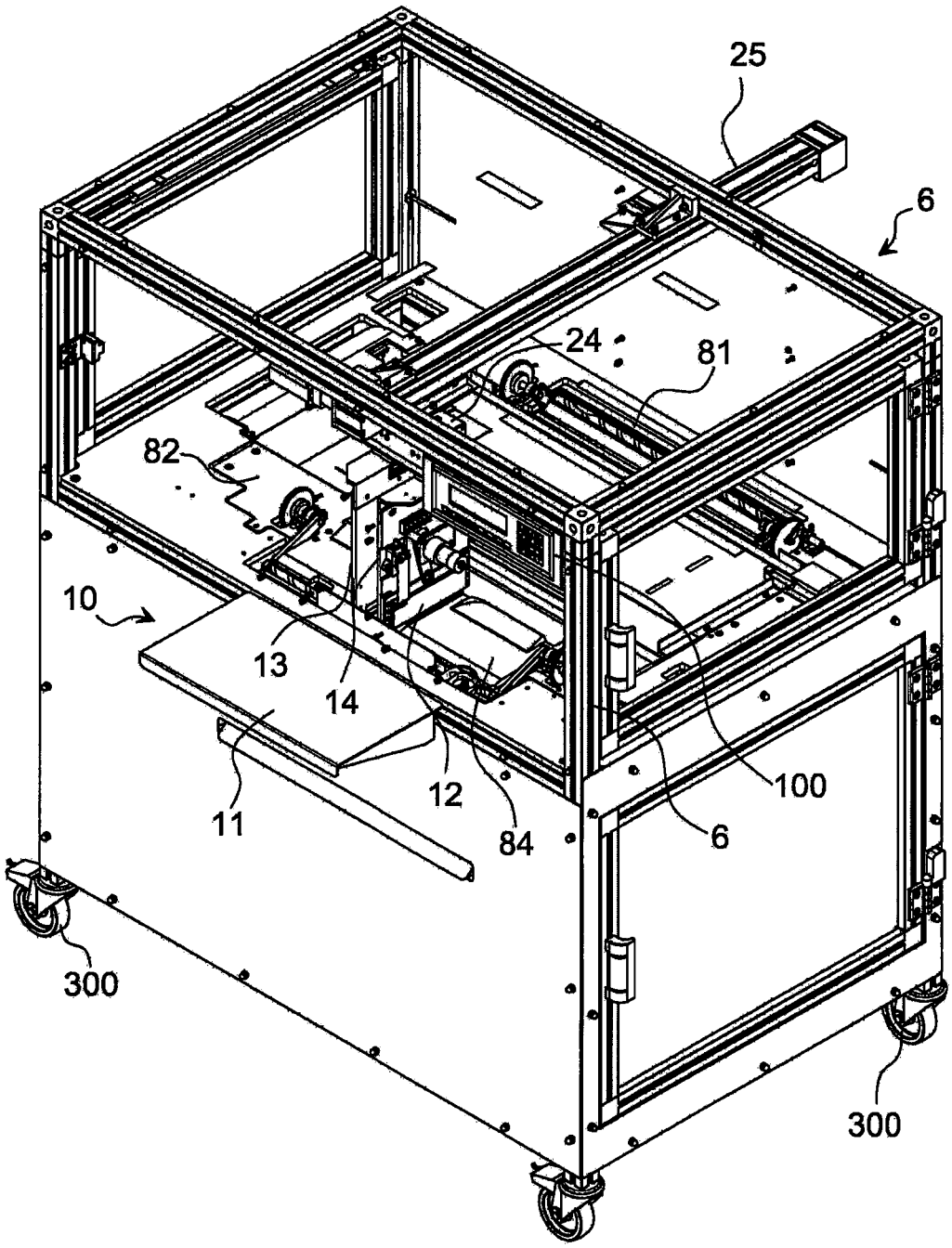
FIGS. 1 to 3 are perspective views of the automatic machine for covering books according to an embodiment of the present invention.
Figure 2:
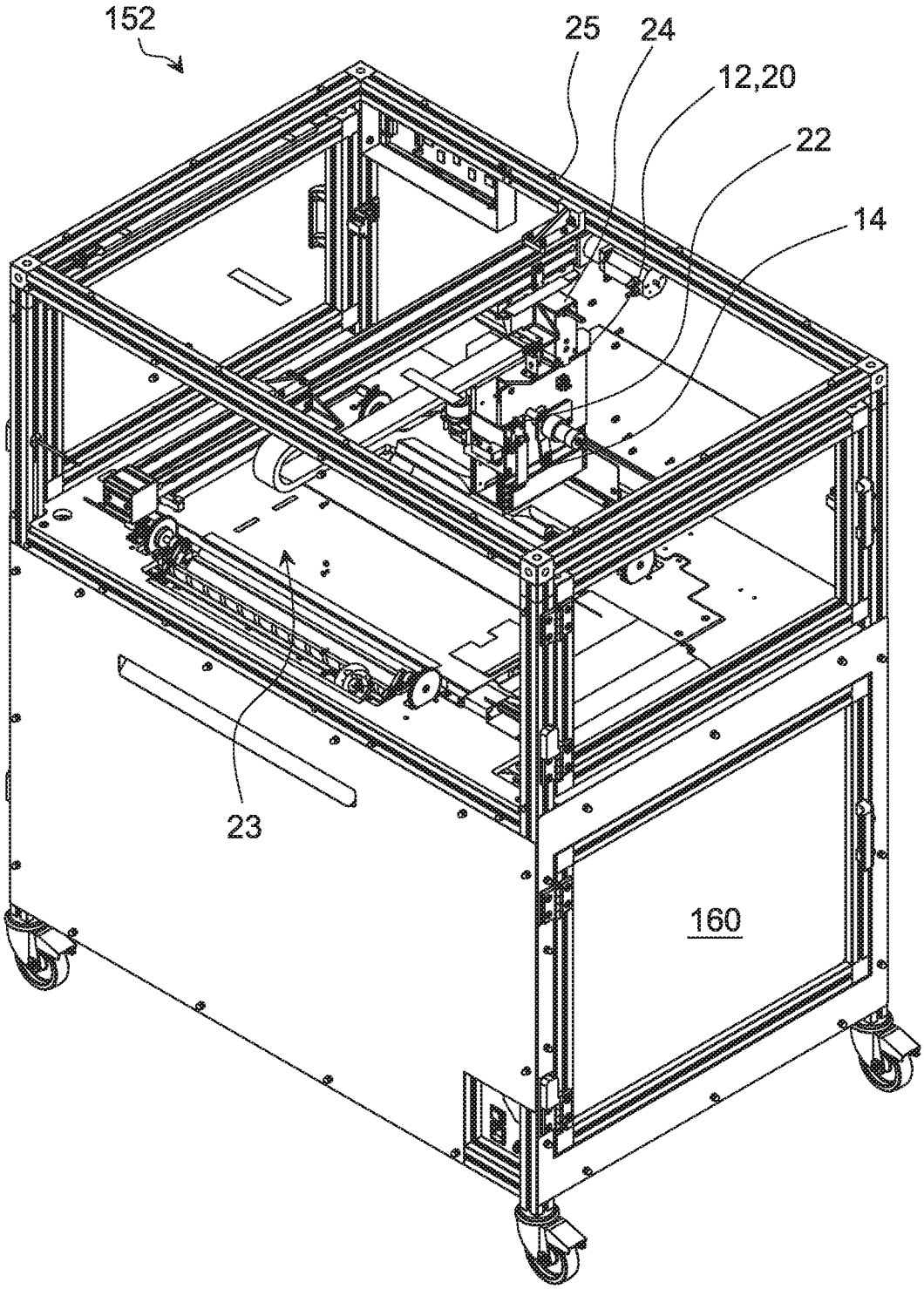
Figure 3:
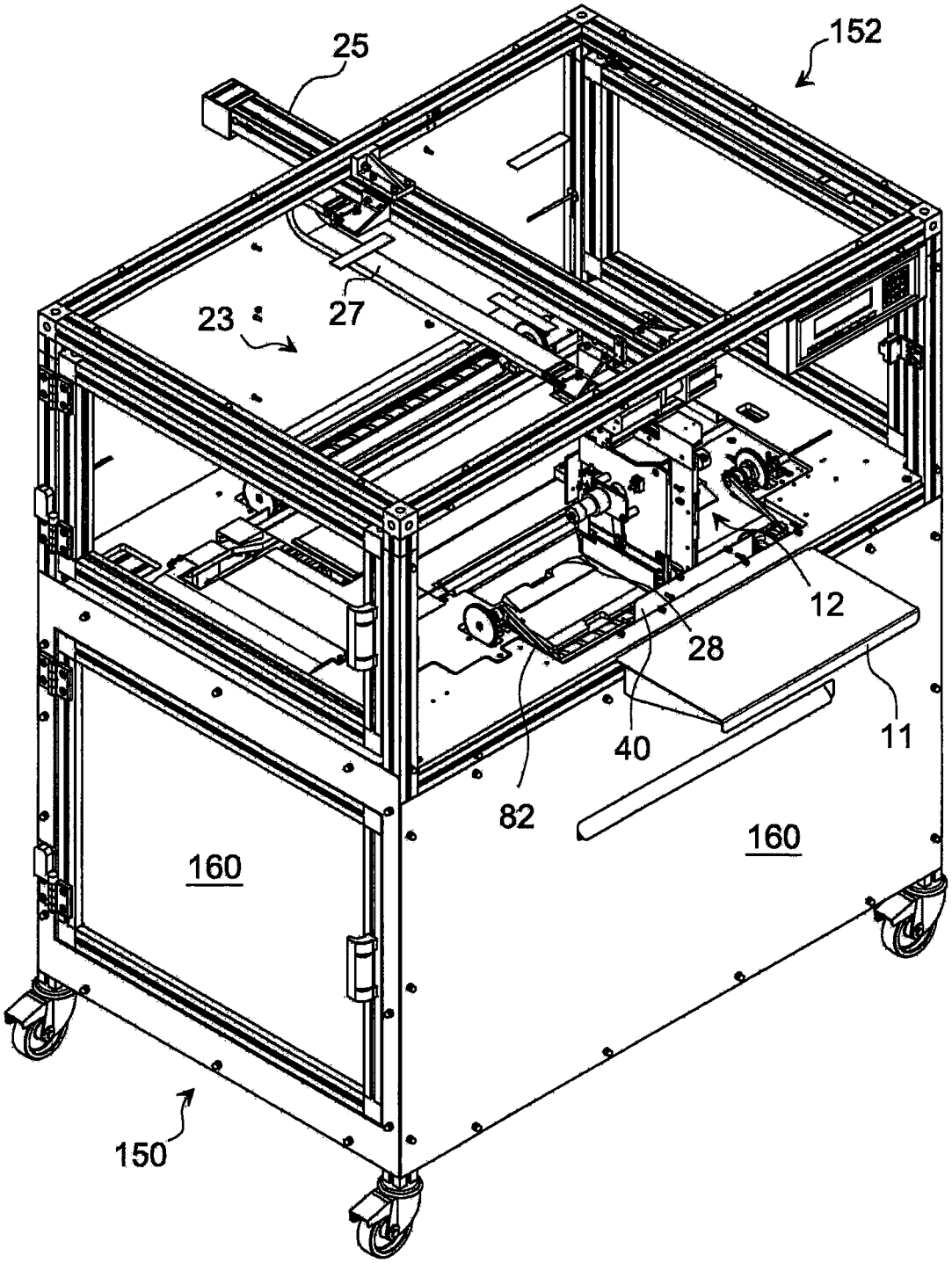
Figure 4:
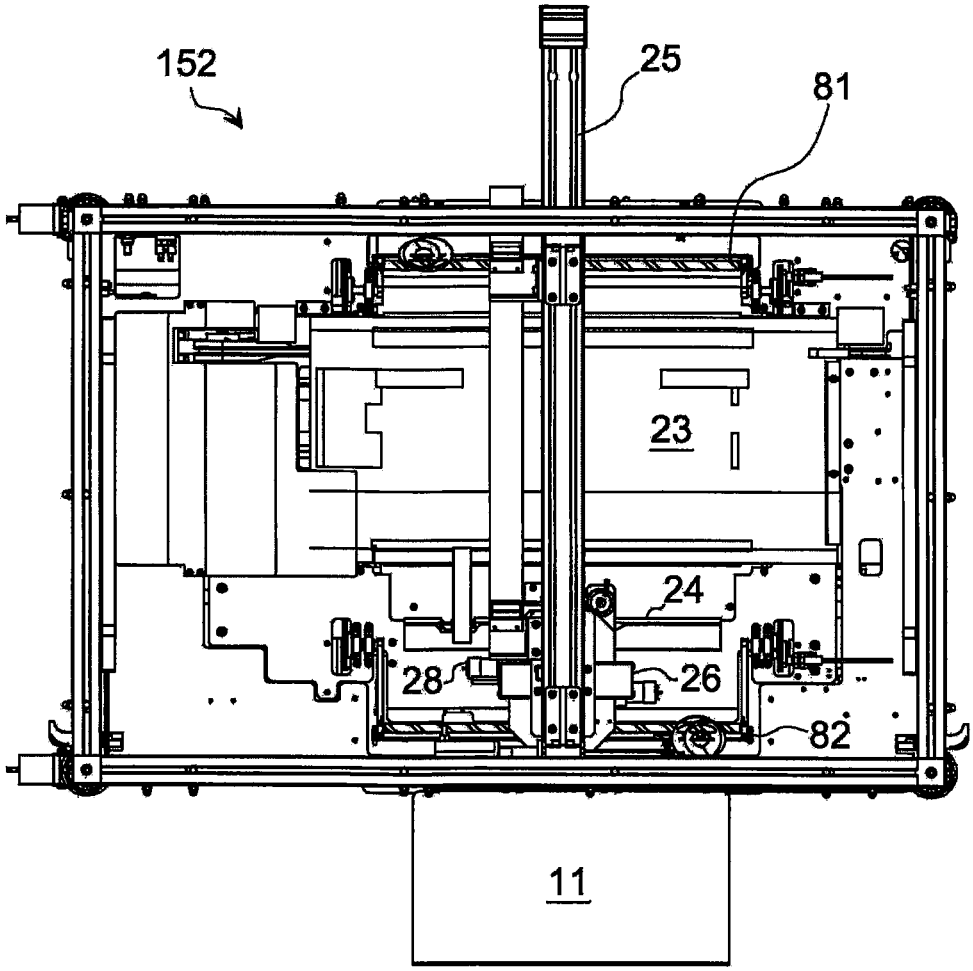
FIG. 4 is a top view of the machine in FIG. 1.
Figure 5:
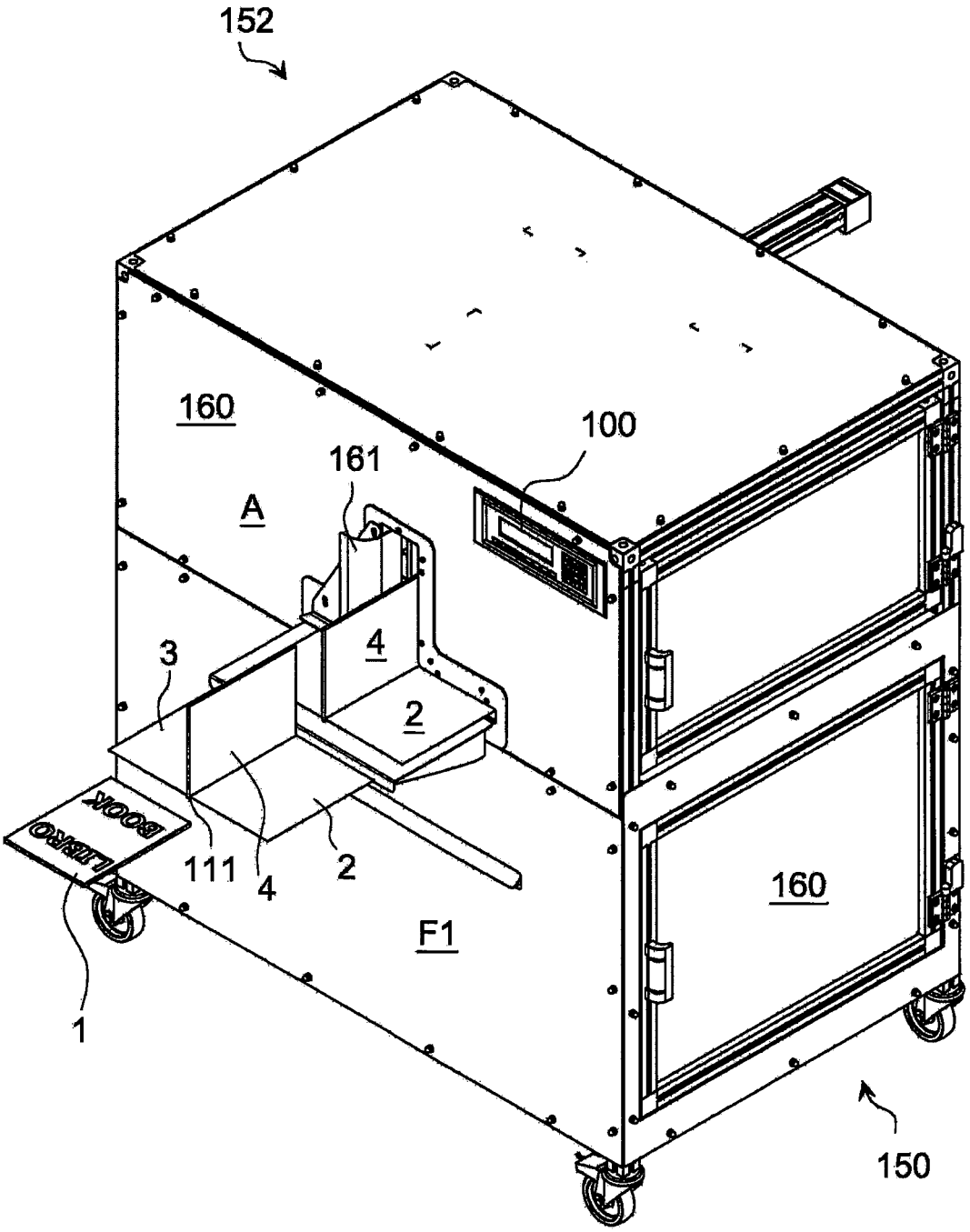
FIG. 5 is a perspective view of the machine in FIG. 1, with closed doors in the step of inserting the book into the machine.
Figure 6A:
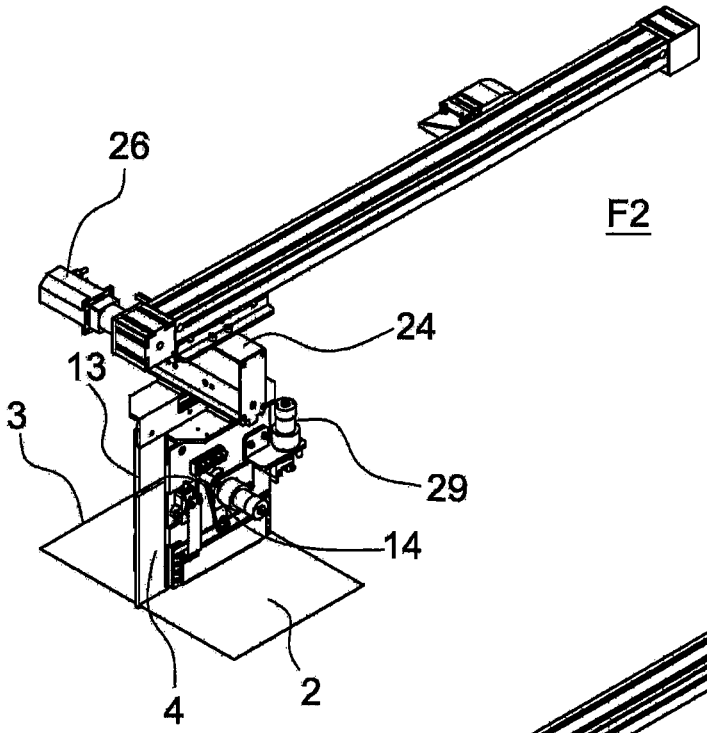
FIGS. 6A, 6B, 6C and 7 show the machine in FIG. 1 in the successive book gripping steps of the machine in FIG. 1.
Figure 6B:
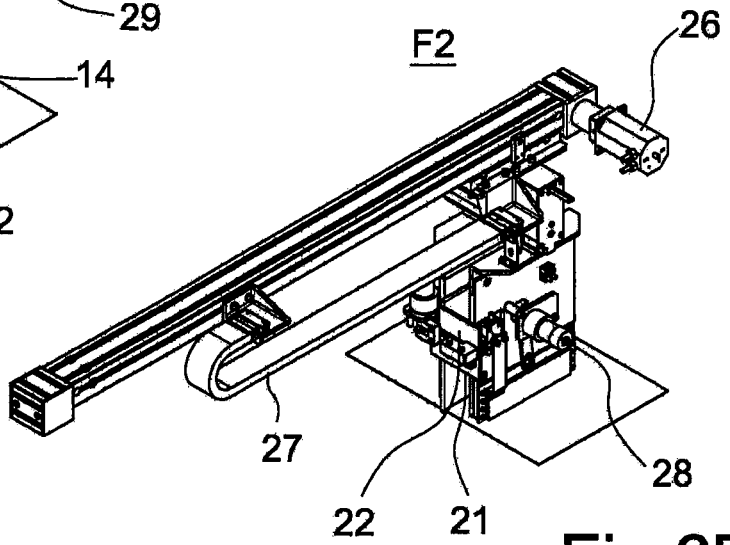
Figure 6C:
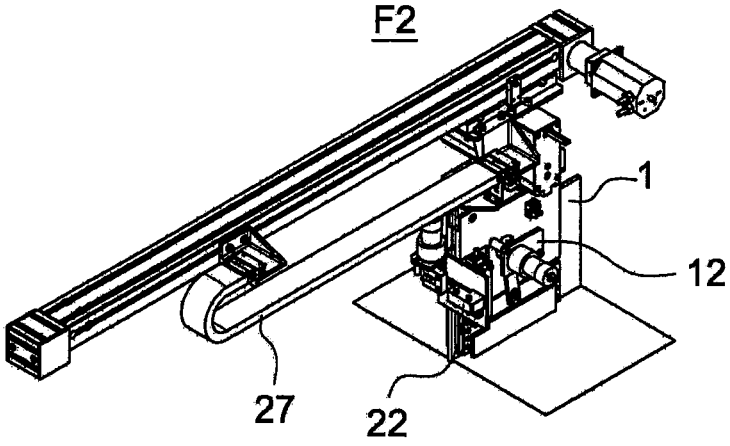
Figure 7:
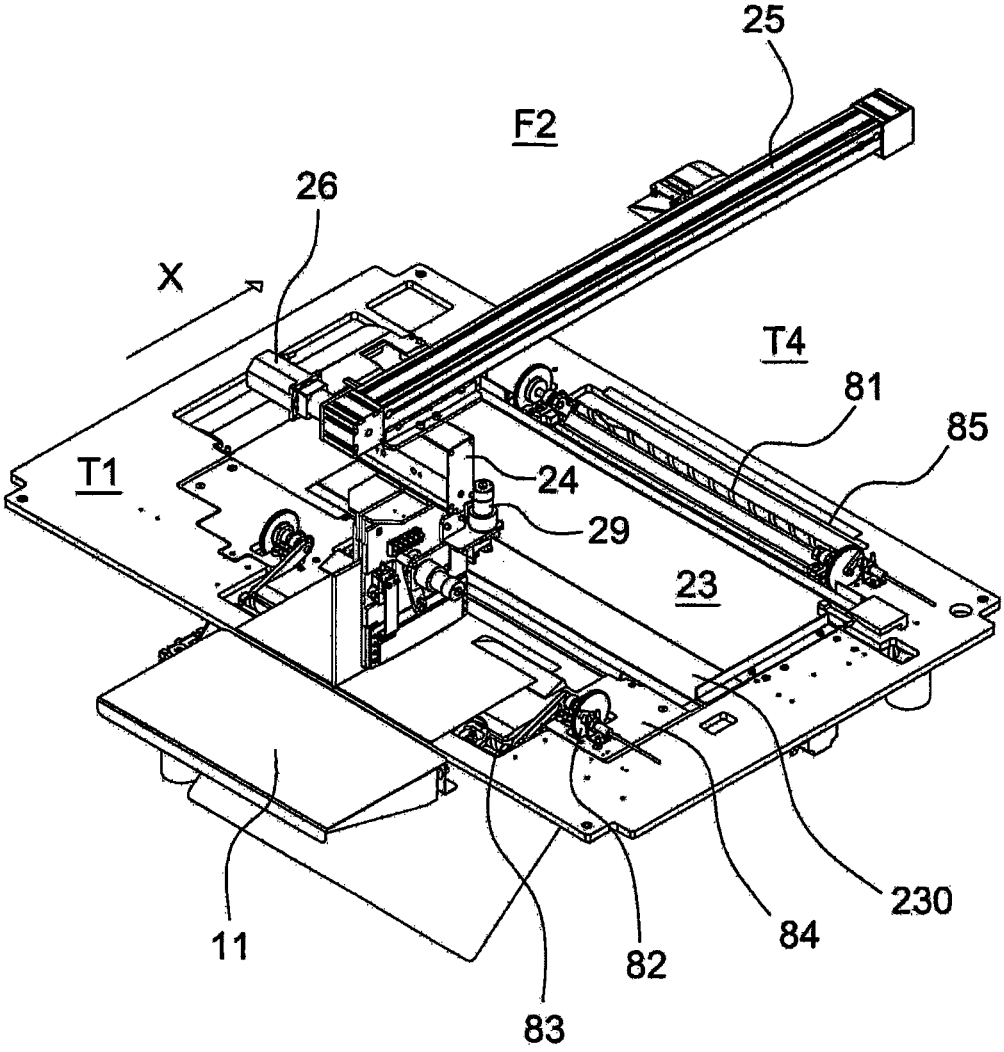
Figure 8A:
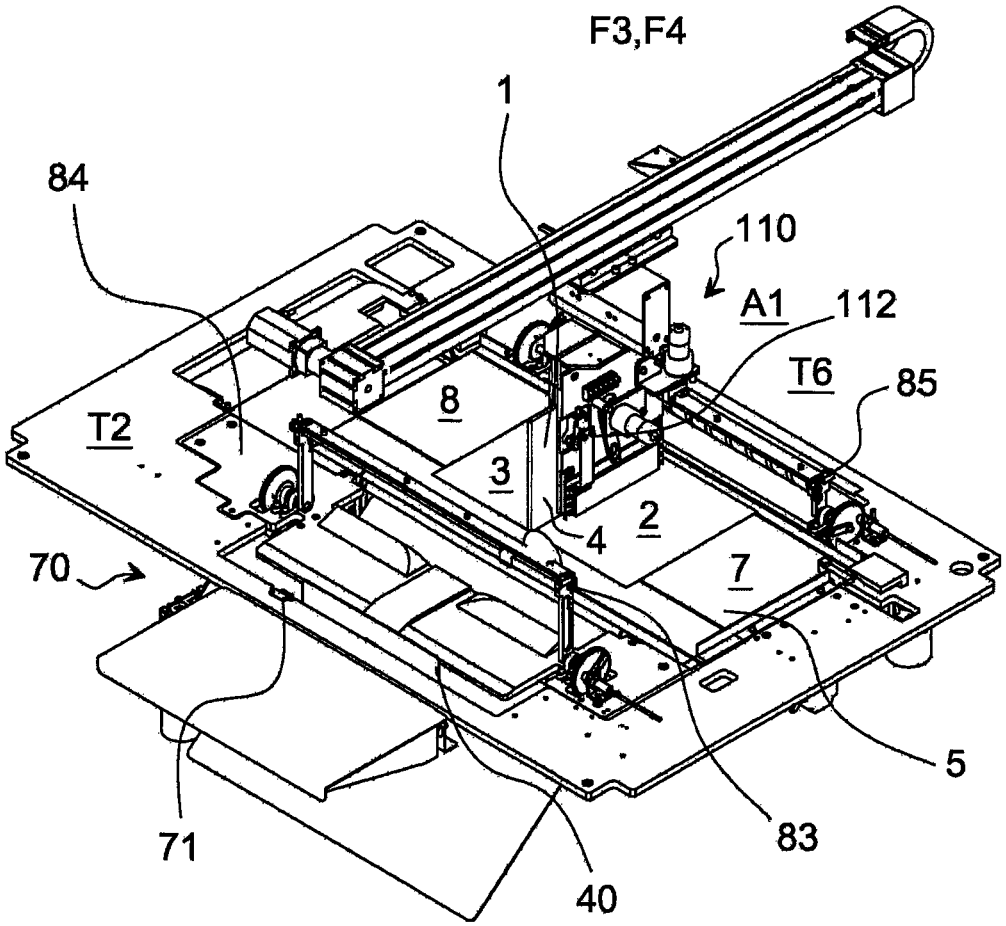
FIG. 8A shows the machine in FIG. 1 in the step of moving the book at the working position.
Figure 8B:
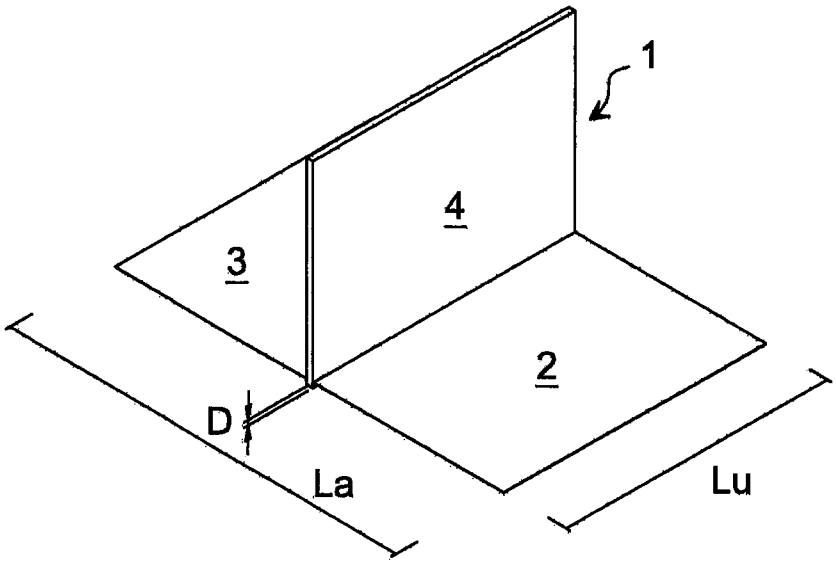
FIG. 8B shows the book to be covered.
Figure 9:
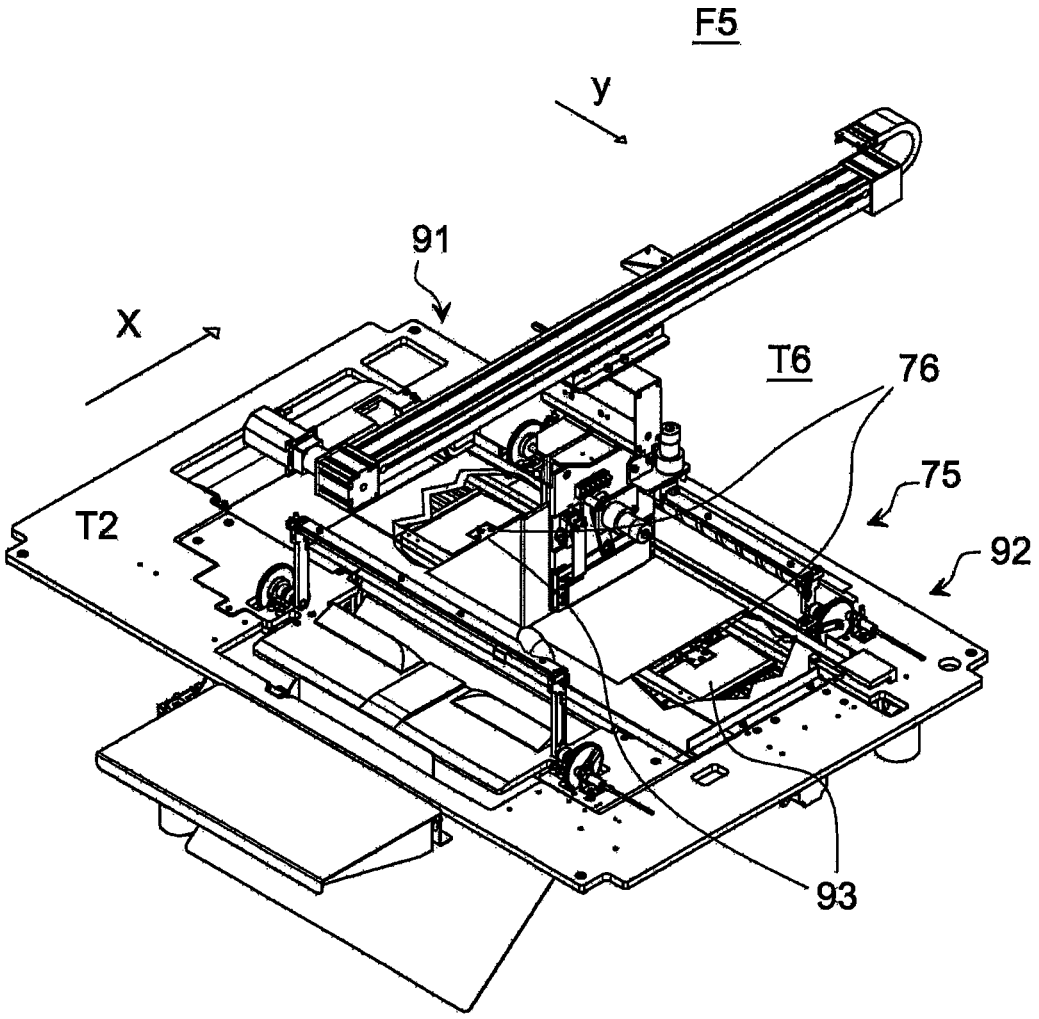
FIG. 9 shows the machine in FIG. 1 in the step of reading the width of the book.
Figure 10:
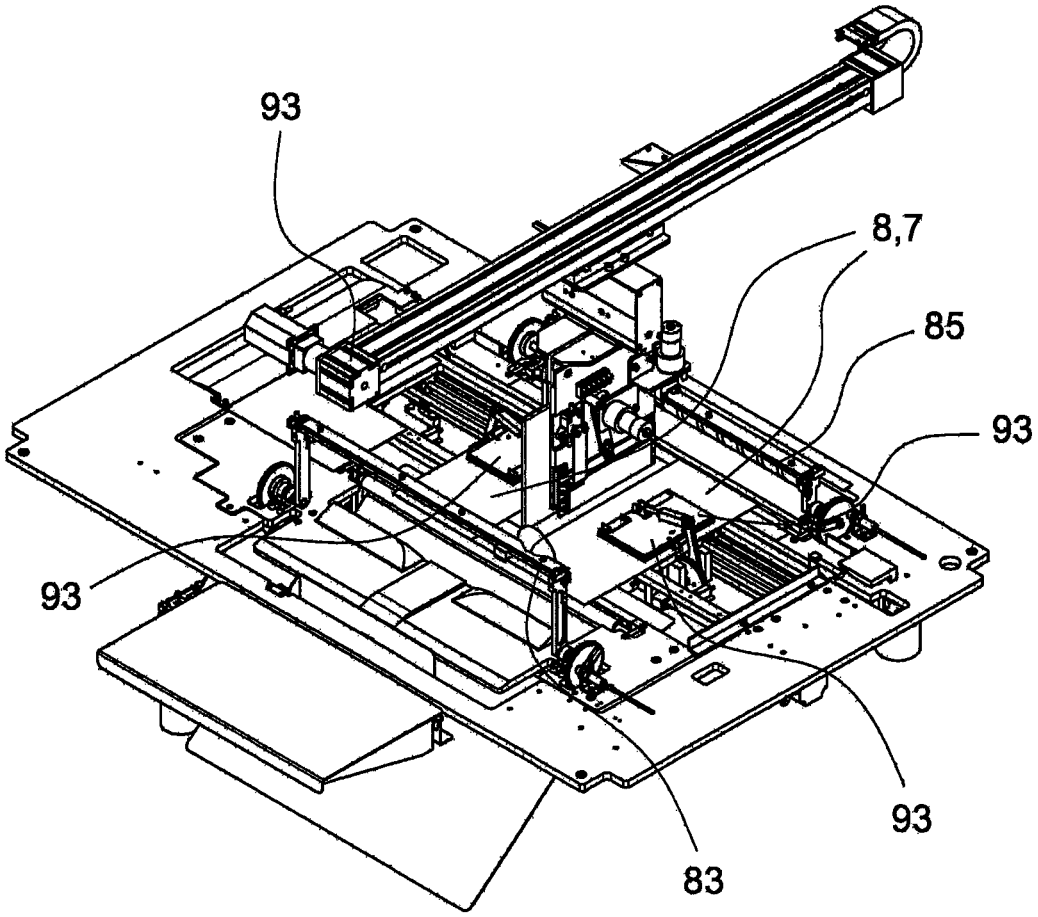
FIG. 10 shows the machine in FIG. 1 in the step of covering the book.
Figure 11:
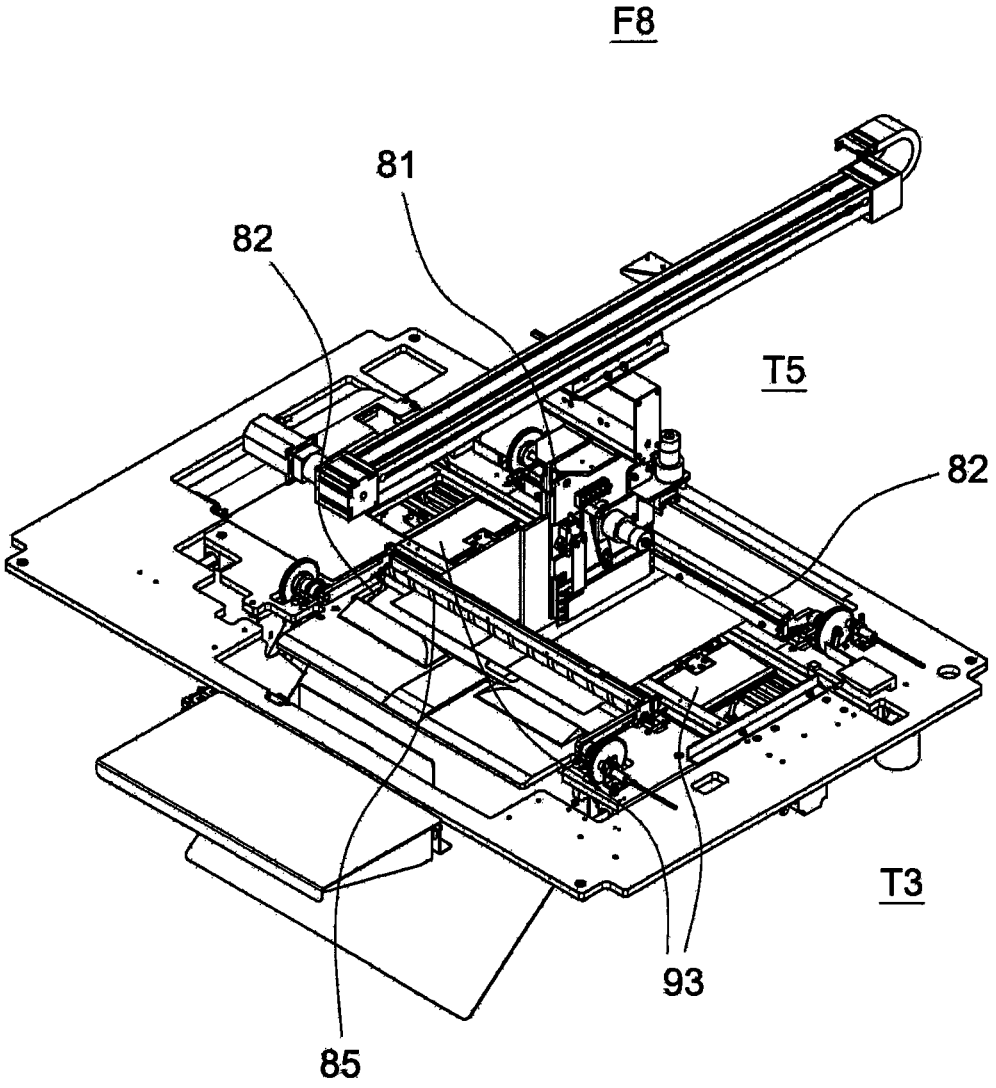
FIG. 11 shows the machine in FIG. 1 in the step of welding and cutting the film covering the book covers.
Figure 12:
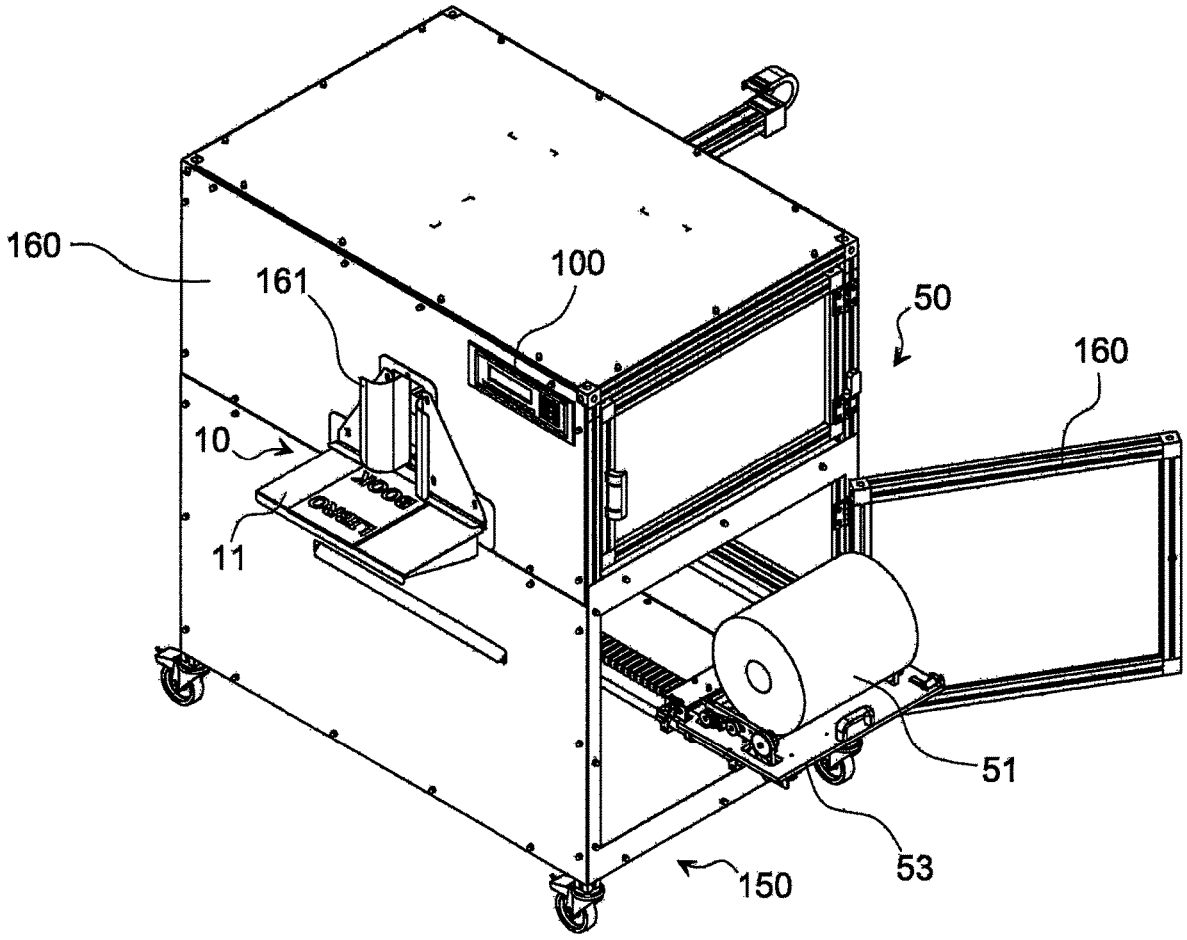
FIG. 12 is a diagrammatic partial view of the lower part of the machine in FIG. 1.

Book 1 to be inserted into the machine is arranged as in FIG. 5, that is with the covers 2, 3 of the book in open position substantially at 90° with respect to body 4 of the book, that is to the block of pages of book 1, and back 111 of the book facing downwards.

The machine comprises means 10 configured to receive a book 1 with the covers 2, 3 in open position substantially at ninety degrees with respect to body 4 of the book and with back 111 of book 1 facing downwards at the input position A. Said means comprise a tray 11 normally arranged on a horizontal plane, and an element 12 provided with a pair of walls 13, 14 perpendicular to tray 11; book 1 is inserted by a user so that the book covers 2, 3 rest on tray 11 and body 4 of the book is inserted inside the walls 13, 14 of element 12, as shown in FIG. 5. The machine normally is closed by doors 160; the reception means 10 and gripping means 20 are arranged in the upper part 152 of the machine and the reception means comprise an opening 161 for facilitating the input of book 1 into the machine.

Element 12 belongs even to the means 20 for gripping the book, in addition to allowing the arrangement of the body 4 of book 1 inside the walls 13, 14. The gripping means 20 comprise a sensor 21 accommodated in a rear wall 22 arranged perpendicular to the walls 13, 14 and to tray 11, as shown in FIGS. 2 and 6A to 6C; when the book body inserted between the two walls 13, 14 comes in contact with sensor 21, the walls 13, 14 close on the body 4 of book 1 to grip it when it is arranged outside the work plane 23 and transport it to the working position A1, arranging it over a film sheet 5 already arranged over the work plane 23, in order to cover the book covers 2, 3. The work plane 23 is defined by a part 230 of frame 6 of the machine.

Element 12 is carried by a carriage 24 sliding on an upper crosspiece 25 of frame 6 of the machine; the carriage is moved by an electric motor 26 and a belt 27 engaged with the electric motor 26 and with element 12. The gripping means 20 also comprise motors 28 adapted to allow to close the walls 13, 14 on the body 4 of book 1 to grip the book.

Once the operation of covering the covers 2, 3 of book 1 with the film sheet 5 has been completed, element 12 is adapted to transport book 1 outside the work plane 23 to unload it. Preferably, the rear wall 22 is moved by an electric motor 29 which causes the opening thereof to unload or eject book 1 once the operation of covering the book has been completed.

Preferably, the film sheet 5, preferably a clear film sheet or of the colored and clear type, preferably a plastic film, derives from a film coil 51 and the machine comprises means 50 adapted to produce film sheets 5 and means 60 adapted to arrange the film sheet 5 on the work plane 23, as better seen in FIGS. 12 to 16. The means 50 (FIGS. 12 to 14) are arranged in the lower part 150 of the machine and comprise moving means 52 for unwinding the coil (preferably a roll), means 53 adapted to carry coil 51 and which can be extracted from the machine, means 54 for measuring the film sheet 5 and a blade 55 for cutting the film sheet 5. Preferably, coil 51 comprises notches for the predetermined measuring of the film sheets 5, and the means 54 comprise a laser sensor 56 which detects the presence of the notches on the film of the coil and allows to stop coil 51 in order to cut the film by means of blade 55. The means 60 preferably comprise a belt element 61 (FIG. 14) for carrying the cut film sheet 5 up to an end 62 of the work plane 23, and a gripper 63, which is movable along axis Y by suitable moving means (for example an electric motor with belt and guide for gripper 63), adapted to take the film sheet 5 (FIG. 15) and arrange it on the work plane 23 (FIG. 16); in particular, gripper 63 is adapted to take an end 65 of sheet 5 and drag sheet 5 on the work plane 23 until the gripper reaches end 66, opposite to end 62, of the work plane 23.

Element 12 carries book 1 inside the machine up to the work position A1 in which it places book 1 onto the film sheet 5 arranged on the work plane 23.

The machine also comprises a movable gate 40 adapted to be raised with respect to the horizontal plane A of tray 11 to prevent the input of another book to be covered during the operation of covering book 1.

Devices 70 for measuring the length Lu of book 1 are activated when transporting book 1 towards position A1; said measure devices preferably comprise two sensors 71, in particular two photo-electric cells, arranged on the work plane 23 and adapted to measure the length Lu of the book. Once book 1 has reached position A1, the devices 75 for measuring the width La of the book are activated; said measure devices are two photo-electric cells 76 adapted to measure the width La of the book.

The machine comprises means 80 for welding and cutting the film sheet 5, which comprise a device 81 and a device 82. The welding and cutting means 80 are adapted to cut and weld the sheet of the film sheet 5 already folded by the first 91 and the second 92 folding means, both on the upper and the lower side of the book. Device 81 is arranged close to position A1 on the work plane, while device 82 is arranged outside the work plane 23 and close to the input position A of book 1. Device 82 is configured to translate towards and away from the work plane 23 along axis X; device 82 is configured to translate towards the work plane 23 along axis X as a function of the length Lu of book 1 measured by the measure devices 70. Device 82 comprises a tray 84 and a cutting and welding blade 83 which is configured to rotate from a rest position T1 to an intermediate rest position T2, up to a work position T3 for laterally welding and cutting the film sheet 5, where position T3 rests on the horizontal plane coplanar to the work plane 23, preferably, position T1 is below the horizontal plane coplanar to the work plane 23, for example in a position in which the cutting and welding blade should perform a rotation by an angle of 200° to reach position T3, and preferably position T2 is over the horizontal plane coplanar to the work plane 23, for example in a position in which the cutting and welding blade should perform a rotation by an angle of 90° with respect to position T3. Device 81 comprises a cutting and welding blade 85 which is configured to rotate from a rest position T4 to an intermediate position T6, up to a work position T5 on the work plane 23 for laterally welding and cutting the film sheet 5, where position T5 rests on the horizontal plane coplanar to the work plane 23, preferably, position T4 always lies below the horizontal plane coplanar to the work plane 23, but in a position in which the cutting and welding blade 85 should perform a rotation by an angle of 180° to reach position T5, and preferably position T6 is over the horizontal plane coplanar to the work plane 23, for example in a position in which the cutting and welding blade 85 should perform a rotation by an angle of 90° with respect to position 15.

The machine comprises first 91 and second 92 means for folding the respective ends 7, 8 of the film sheet 5 on the book covers 2, 3. The first 91 and second 92 folding means are adapted to carry the side ends 7, 8 of the film sheet 5 on the internal part of the covers 2, 3 of book 1. The first 91 and second 92 folding means each comprise a flap 93 moved by an electric motor 94; each flap 93 is capable of shifting on the work plane 23 along an axis Y, perpendicular to axis X but coplanar thereto, to fit the width of book 1 and is capable of rotating by 180° to fold the ends 7, 8 of the film sheet 5 on the covers 2, 3. The flaps 93 are arranged on the work plane 23 when they shift or are in rest position; the flaps 93 preferably comprise the two photo-electric cells 76 adapted to measure the width La of the book.

The machine comprises a control unit 100 adapted to control said welding and cutting means 80 and said first 91 and second 92 folding means as a function of the dimensions of the book; said control unit 100 controls the first 91 and the second 92 folding means to carry the side ends 7, 8 of the film sheet 5 on the internal part of the covers 2, 3 of book 1 and then the welding and cutting means 80 to cut and weld the sheet of the film sheet 5 already folded by the first 91 and second 92 folding means, both on the upper and the lower side of the book. The control unit 100 controls the means 50, the means 60, the reception means 10 and the gripping means 20, and the various measure means for measuring the length Lu, the width La and the bordure D of book 1, and calculates the length Lu, the width La and the bordure D of book 1.

The machine comprises means 110 for measuring the bordure of the book, that is thickness D created between covers 2,3 and edge 111 of the book when the book is made and due to the gluing of the book pages with the material of edge 111 of the book.

The measure means 110 comprise sensors 112 arranged in the walls 13, 14 of element 12; when the book is at the position A1, the walls 13, 14 are lowered onto book 1 so as to allow the measurement of bordure D.

As described above, the film sheet 5 preferably derives from a film coil 51 and the machine comprises means 50 adapted to produce film sheets 5 and means 60 adapted to arrange the film sheet 5 on the work plane 23, as better seen in FIGS. 12 to 16. The means 50 (FIGS. 12 to 14) are arranged in the lower part 150 of the machine and comprise moving means 52 for unwinding the coil (preferably a roll), means 53 adapted to carry coil 51 and which can be extracted from the machine, and a blade 55 for cutting the film sheet 5. Alternatively, there are no notches on the film of coil 51 and there is no need for means 54; blade 55 is controlled by unit 100 as a function of the width La of book 1. Indeed, the machine according to the invention comprises further devices for measuring the width La of the book given by the width of the covers 2, 3 of book 1 and by the width of the edge 111 of book 1; said measure devices preferably are arranged in the part of the machine adapted to receive the book from the outside, that is close to tray 11, at the input position A of book 1. The control unit 100 processes the measurement taken by said further devices for measuring the width La of the book and controls the moving means 52 to unwind the coil up to the measurement processed and then controls blade 55 to cut the film sheet 5 by said measurement processed.

The machine works in the following manner. All the various work steps of the machine according to the invention are coordinated by the control unit 100.

Initially in step F1, book 1 is arranged on tray 11 with the covers 2, 3 in open position, that is substantially rotated by 90° with respect to the body 4 of book 1 and with back 111 facing downwards. Device 82 is stopped and the cutting and welding blade 83 is in position T3, the cutting and welding blade 85 of device 81 is in position T4 and the flaps 93 of the first and second folding means are coplanar to the work plane 23; the film sheet 5 is arranged over the work plane 23.

Then in step F2, the body 4 of book 1 is inserted into the reception element 12 between the walls 13, 14 up to touching sensor 21 arranged on wall 21.

The contact of body 4 with sensor 21 is detected by the control device 100 which controls the motors 28 to close the walls 13, 14 on the body 4 of book 1 to grip book 1. The control device 100 controls the heating of the electric resistors of the devices 81 and 82 up to reaching a given temperature (for example 130° C.) for the successive welding operation.

Then (step F3), once book 1 has been taken by the gripping means 20, the control device 100 controls the gripping means 20 to raise the book itself and transport it to position A1 by translating along axis X; the transport of the book 1 occurs like a dragging operation of book 1 since the covers 3, 4 are always kept in open position substantially at 90°, in the transporting operation, and the covers rest on tray 84 which is configured to translate to then reach the work plane 23. The arrival at the position A1 is indicated by specific means, for example an encoder mounted on the motor.

In the translation, book 1 passes over device 82 thus activating the sensors 71 for measuring the length Lu of book 1; when the book reaches position A1, the control device 100 controls raising gate 40 and the arrangement of the cutting and welding blade 93 of device 82 from position T1 to position T2 over the work plane 23, and of the cutting and welding blade 85 of device 81 in position T6.

Then (step F4), the control device 100 controls element 12 to partly release book 1 onto the film sheet 5 already arranged on the work plane 23 and controls lowering the walls 13, 14 onto the covers 2, 3 of book 1 so the sensors 112 measure bordure D of the book.

Then, there is the operation (F5-F8) of covering the covers 2, 3 of book 1 with the film sheet 5.

In step F5, the control device 100 controls the flaps 93 to shift along axis Y, perpendicular to axis X, so as to move away from the area where edge 111 of the book is arranged; the flaps 93 carry the sensors 76 adapted to measure the width La of book 1.

Once the width La of the book has been measured, the control device 100 controls the rotation of the flaps 93 on the book covers 2, 3 (for example by 180°) so as to carry the side ends 7, 8 of the film sheet 5 on the internal part of the covers 2, 3, that is in an adjacent manner to the internal part of the covers 2, 3 (step F6).

Then (step F7), the control device 100 controls the shifting of the flaps 93 so that both move away from the edge 111 of book 1 to compensate for bordure D of the book. Thereby the total width of the book is given by the width La+2×D.

Then (step F8), the control device 100 controls the translation of device 82 as a function of the length Lu of book 1 and controls the welding and cutting blades 83, 85 to go to the respective positions T3 and T5 to weld the film sheet 5, that is the folded film sheet 5, both on the upper and lower side of book 1, along axes parallel to axis Y, and cut the film sheet 5, again both on the upper and lower side of book 1, along axes parallel to axis Y, so as to eliminate the remaining part of the film sheet 5. During the welding, the flaps 93 return to the starting position, that is the control device 100 controls the flaps to be arranged in a coplanar manner to the work plane 23 or to a plane parallel thereto.

The successive step F9 provides for the control device 100 to control the devices 81 and 82 to return to the rest positions T4, T2 and element 12 to grip the body 4 of book 1 to transport it outside the work plane 23 on the side of the machine which is opposite to the input part of book 1. In the ejection step of book 1, the rear wall 22 rotates so as to open and allow the ejection or discharge of the book.

In the successive step F10, element 12 is controlled by device 100 to return to the starting position by means of a sliding carriage 24 on the upper crosspiece 25 to receive a new book 1 to be covered; device 82 is controlled by device 100 to return to the initial position with the cutting and welding blade 83 which returns to position T1 to allow the lowering of gate 45.

Preferably, the film sheet 5 comes from a film coil 51; in an initial step D1, the control device 100 controls the moving means 52 to unwind the coil up to the predetermined measurement measured by the measure means 54. The film of the coil preferably comprises measure notches and the means 54 are configured to detect said notches.

Alternatively, in step D1, the control device 100 controls the moving means 52 to unwind the coil up to a predetermined measurement as a function of the width La of the book measured by the further devices adapted to measure the width La of the book which are arranged close to tray 11, preferably at the input position A of the book.

Figure 13:
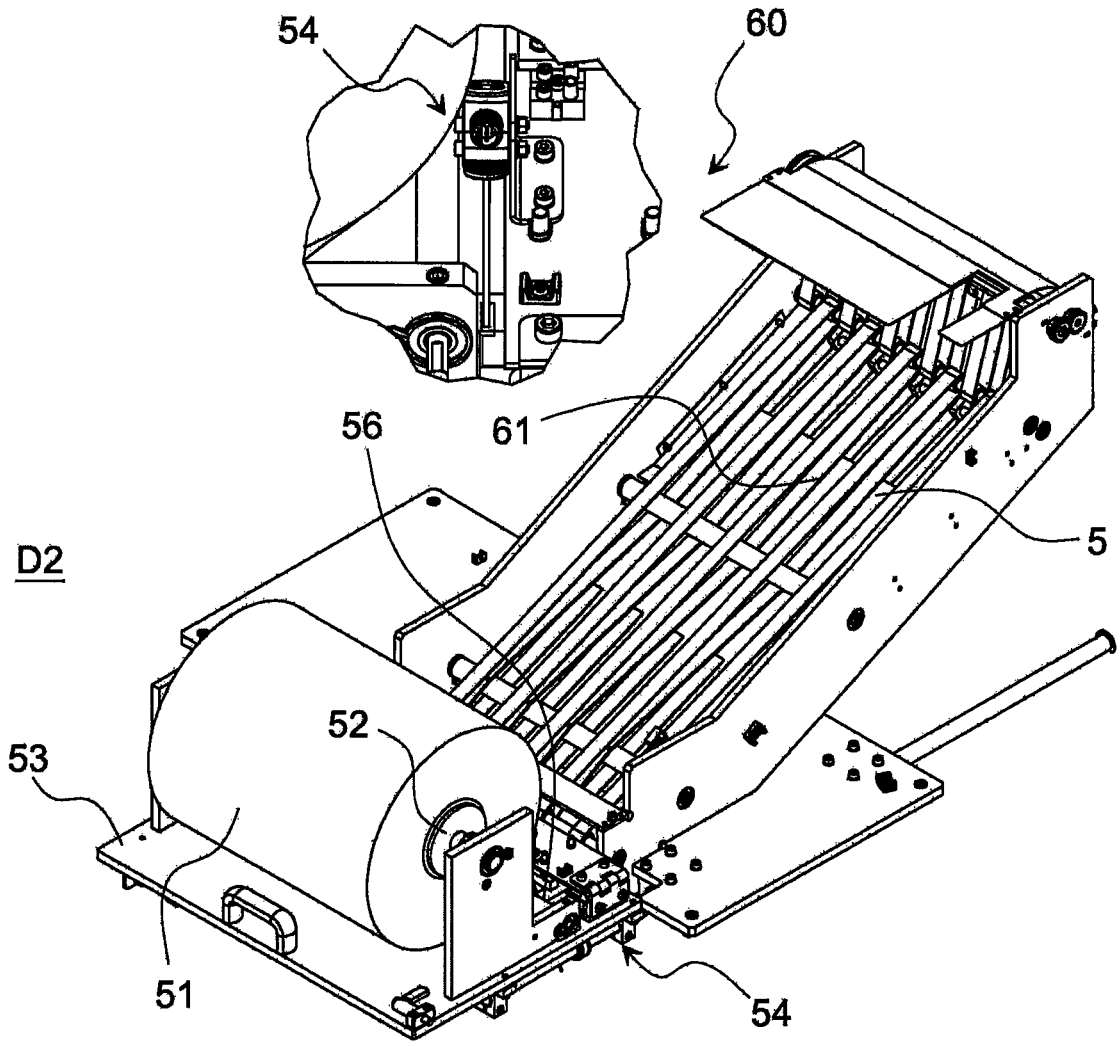
FIGS. 13 and 14 are diagrammatic partial views of the devices for feeding the film sheets at the work plane, which are inserted into the lower part of the machine in FIG. 1.
Figure 14:
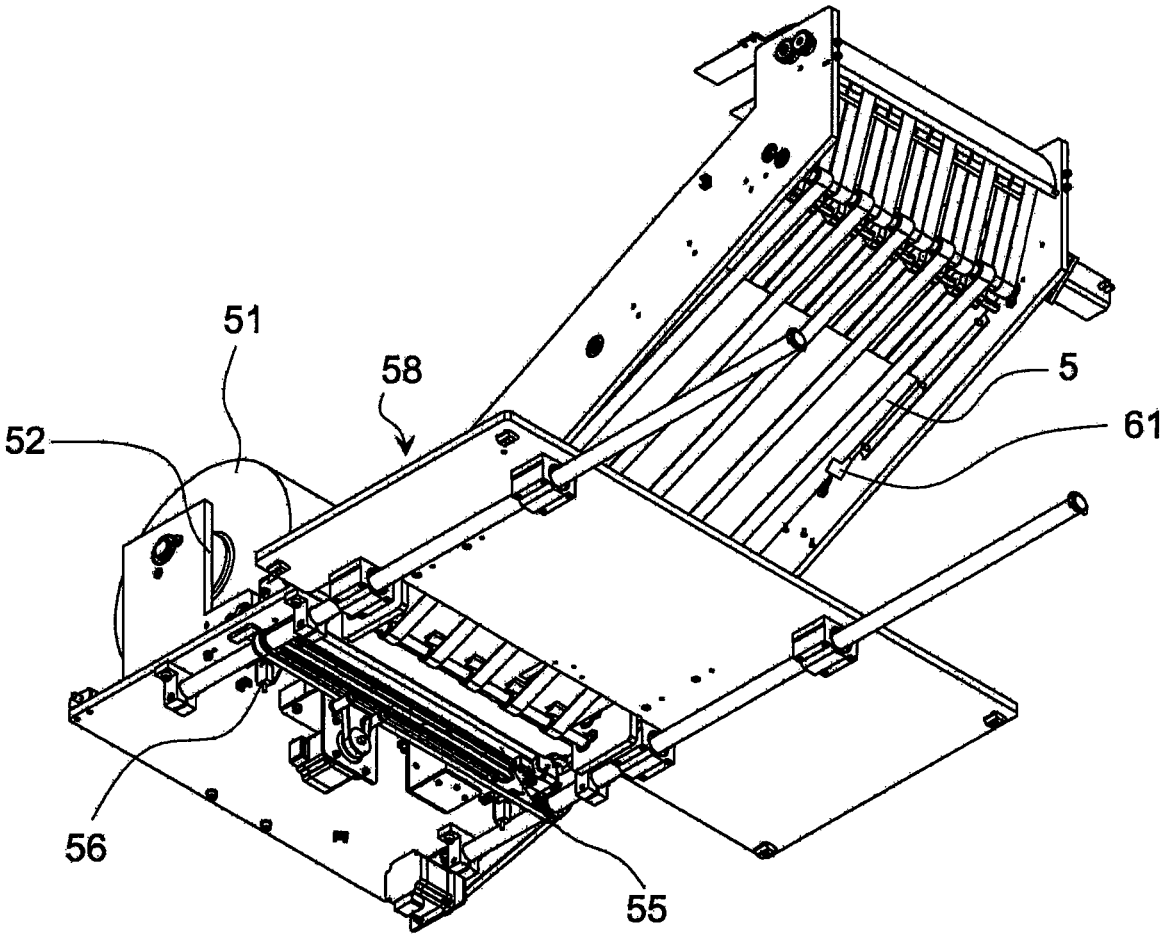
Figure 15:
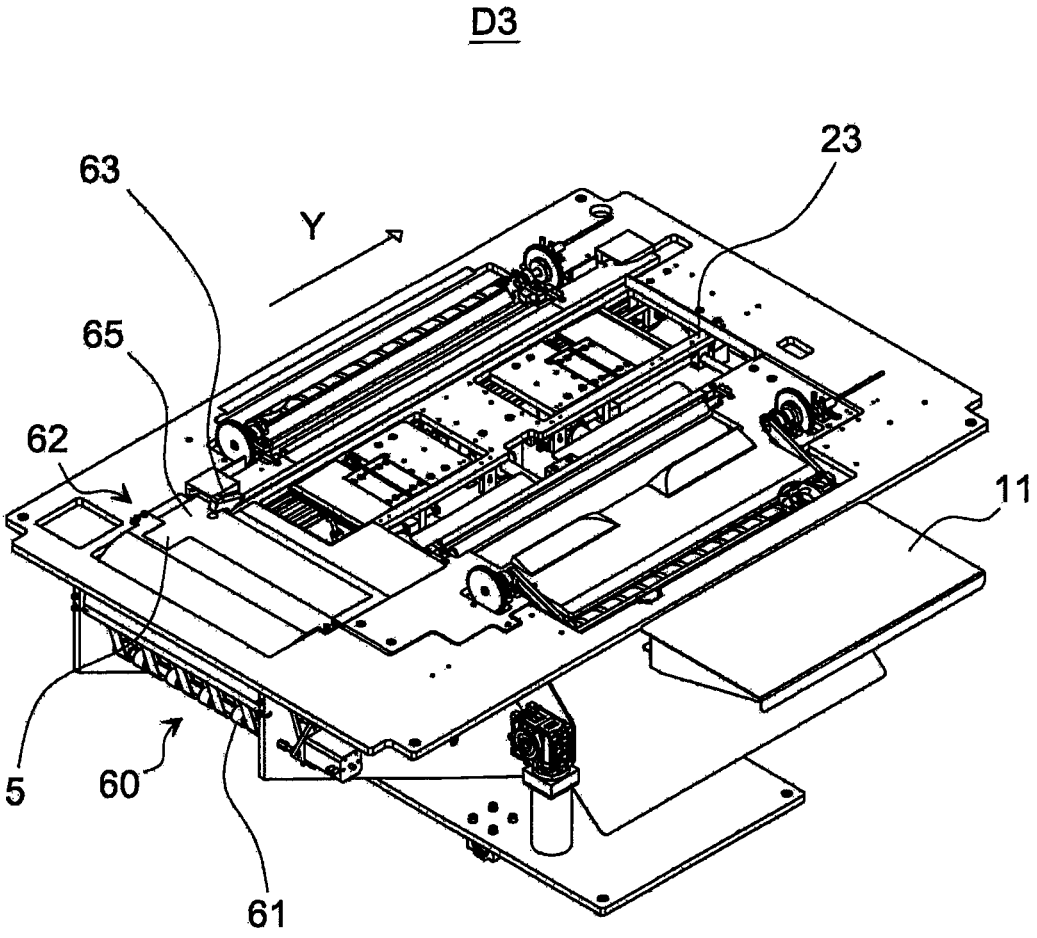
FIG. 15 is a diagrammatic view of the work plane with a film sheet arranged in the initial part.
Figure 16:
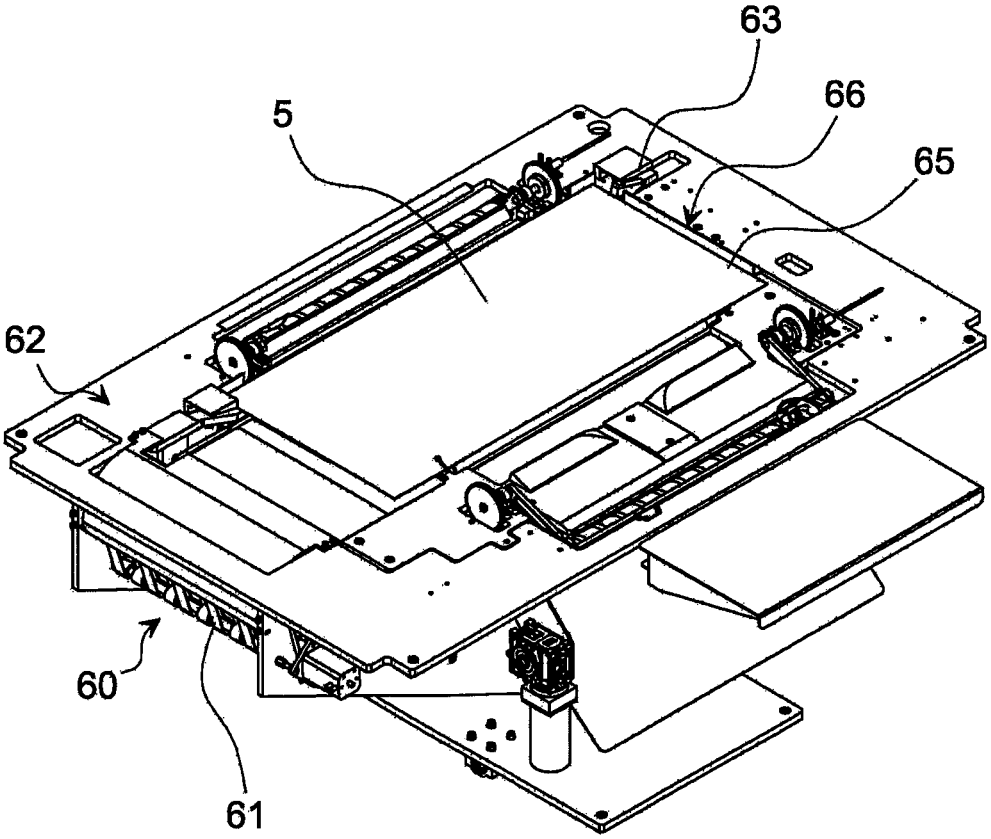
FIG. 16 is a diagrammatic view of the work plane with a film sheet completely arranged on the work plane.

In the successive step D2, the film sheet 5 is cut by means of blade 55 controlled by device 100, and in the successive step D3, the film sheet 5 is carried by the belt element 61 (for example a buffer), again controlled by device 100, up to end 62 of the work plane 23; a pressure unit 58 preferably holds the film sheet unwound from coil 51 stationary only during cutting. FIG. 13 shows step D2 of cutting the film sheet 5 from the film coil 51; the film sheet 5 is arranged between the belts of the belt device 61. FIG. 14 is similar to FIG. 13 and again shows step D2 of cutting the film sheet 5.

In a successive step D4 again, a gripper 63, again controlled by device 100, takes and drags the film sheet 5 to arrange it on the work plane 23.

Preferably, to speed up the operation of covering the book, the steps D1 and D2 for making a new film sheet 5 are carried out during the steps F6-F8 of covering book 1, step D3 is carried out during step F9 and step D4 is carried out after step F10.

The machine according to the invention is compact and provided with wheels 300 for the easy movement thereof.

Figure 17:
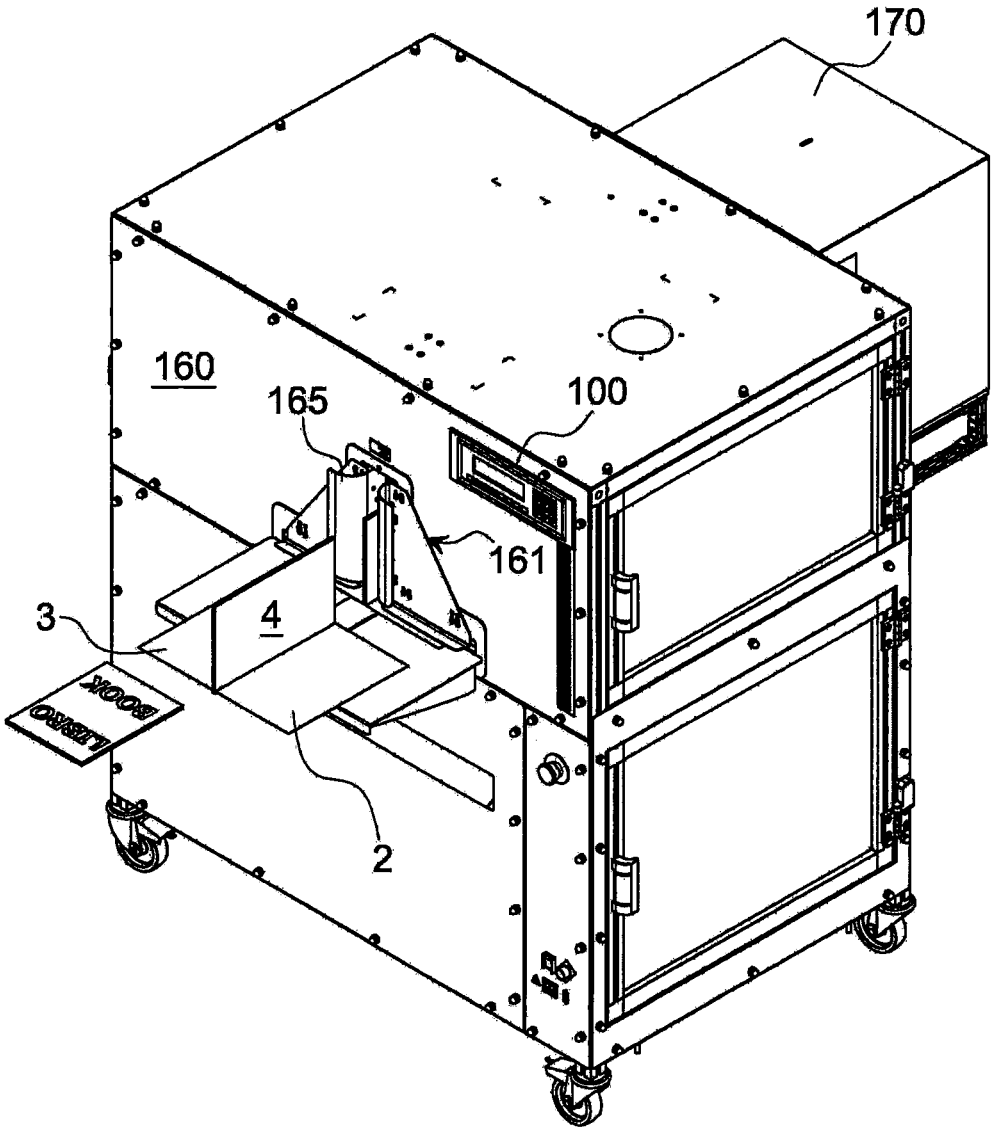
FIG. 17 is a perspective view of the automatic machine for covering books according to a variant of the embodiment of the present invention, with closed doors in the step of inserting the book into the machine.

According to a variant of the embodiment of the present invention, in addition to the elements of the embodiment of the present invention, the automatic machine for covering books comprises fins 165 provided with springs in the opening 161 of the reception means 10, as shown in FIG. 17; the fins 165 provided with springs keep the body 4 of book 1 in vertical position before it is gripped by the gripping means 20. An area 170 for discharging the book with the covers covered by the film sheet 5 is provided.

Figure 18:
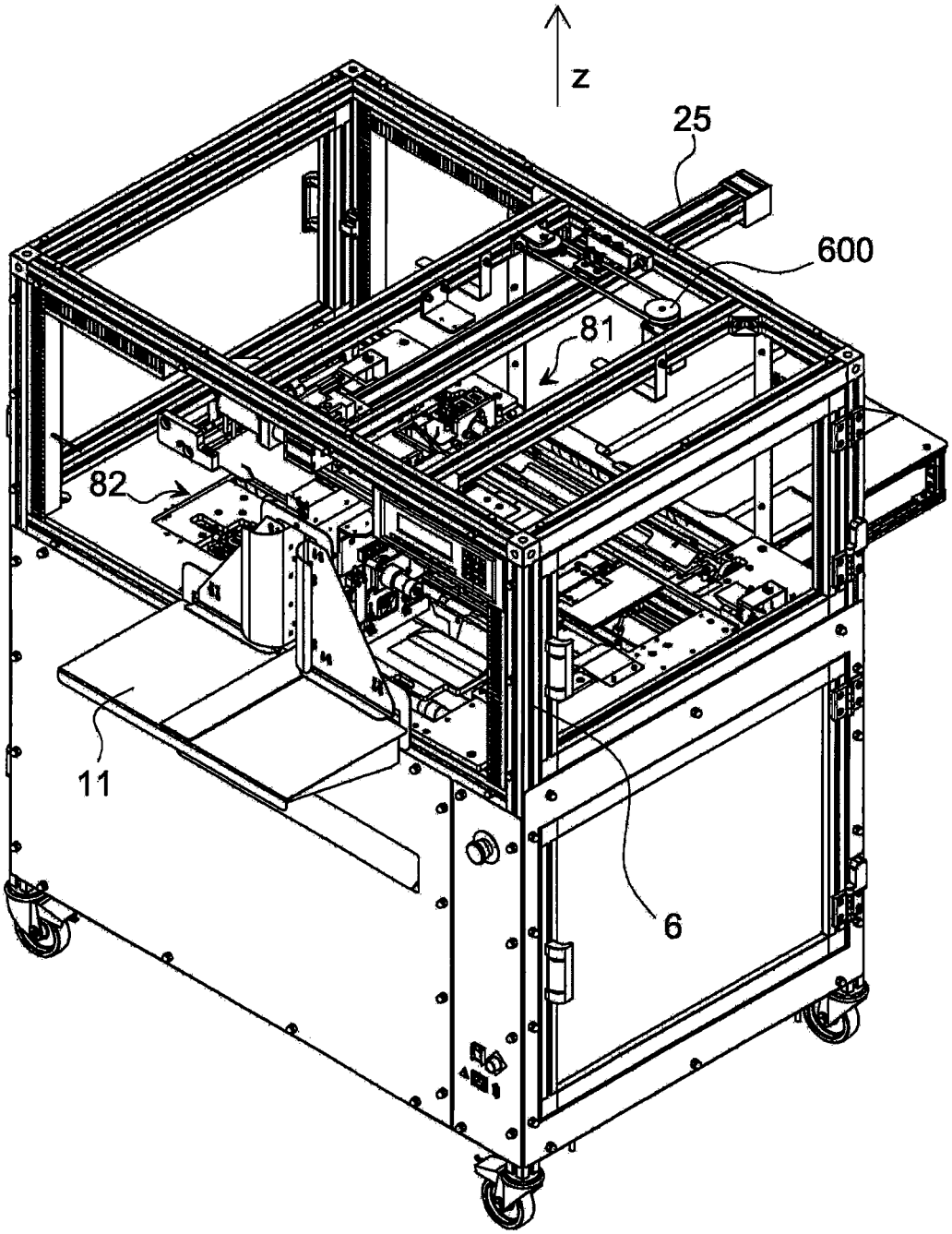
FIGS. 18 to 19 are perspective views of the automatic machine for covering books according to another variant of the embodiment of the present invention.
Figure 19:
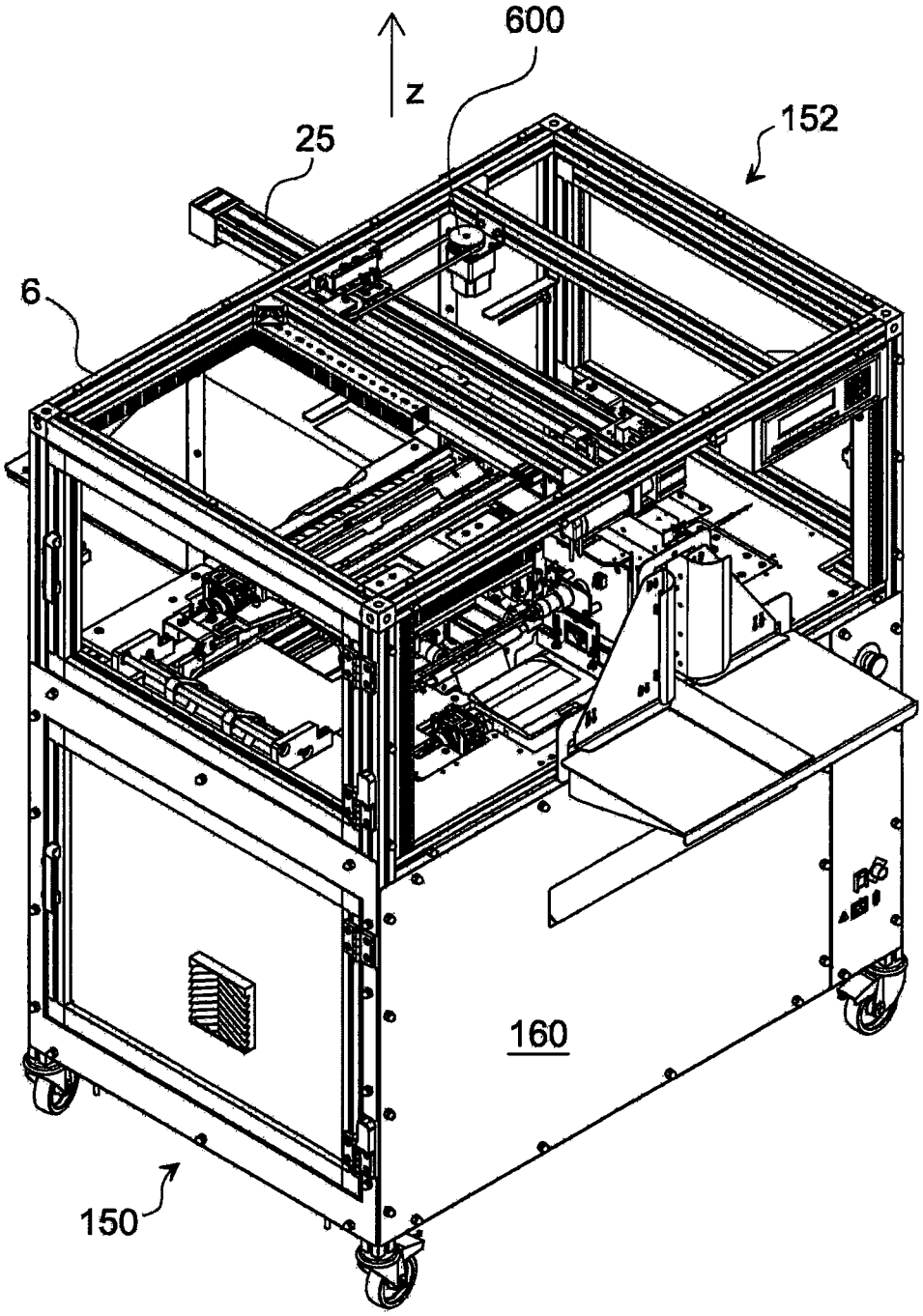
Figure 20:
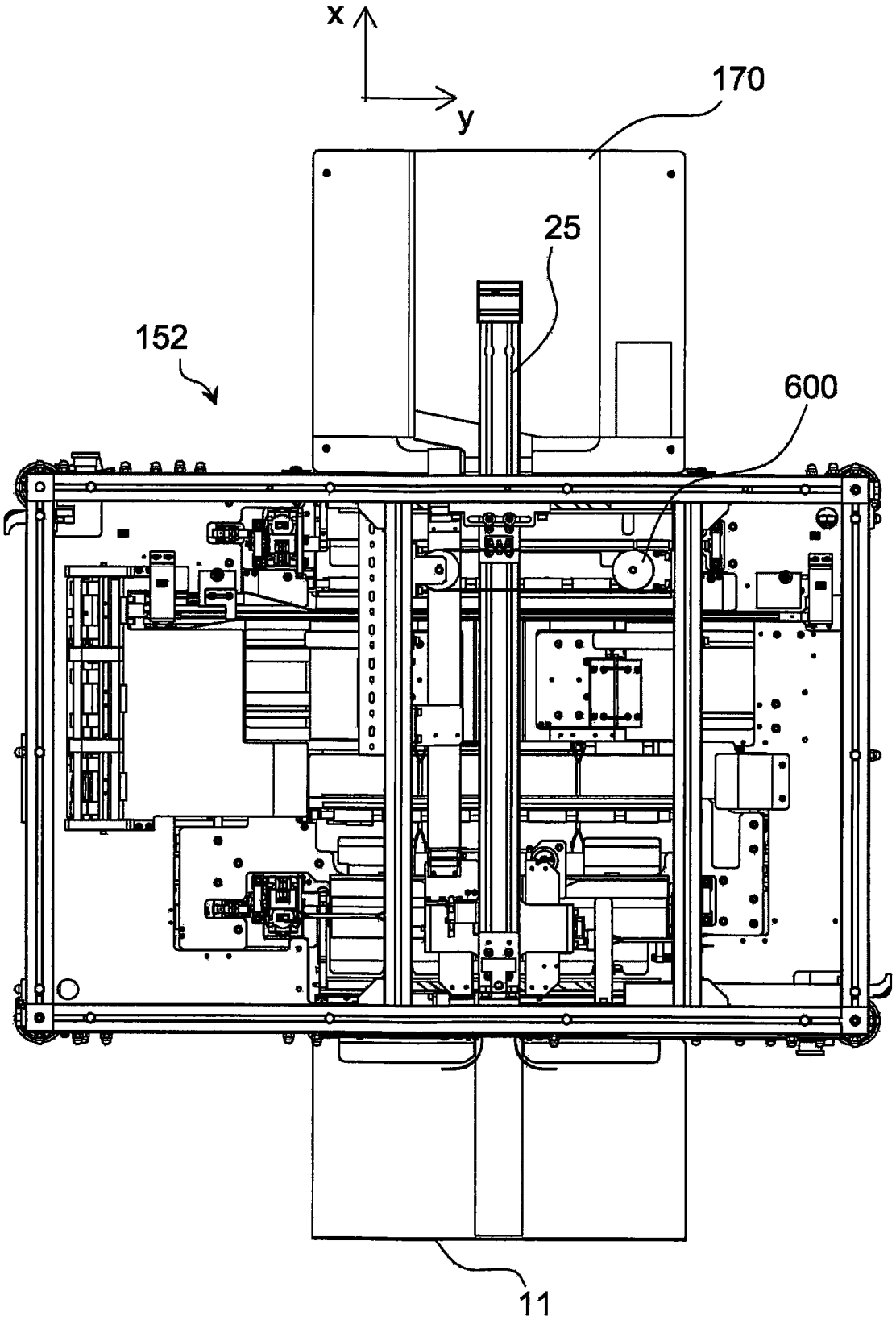
FIG. 20 is a top view of the machine in FIG. 18.

According to another variant of the embodiment of the present invention, in addition to the elements of the embodiment of the present invention or of the variant, the automatic machine for covering books comprises means 600 for rotating the upper crosspiece 25 of frame 6 of the machine about a vertical axis, an axis Z perpendicular to the axes X and Y, as shown in FIGS. 18 to 20. Indeed, the books are not perpendicular and by rotating crosspiece 25, they may be rotated to make the covers 2, 3 parallel to the welding and cutting blades 83, 85; thereby, the folded film sheet 5 is cut and welded on the upper and lower side of book 1 so that the cutting and welding are carried out closer to the edge of the covers 2, 3. Preferably, the upper crosspiece 25 is hinged to frame 6. Preferably, said means 600 comprise a stepper motor.

Figure 21:
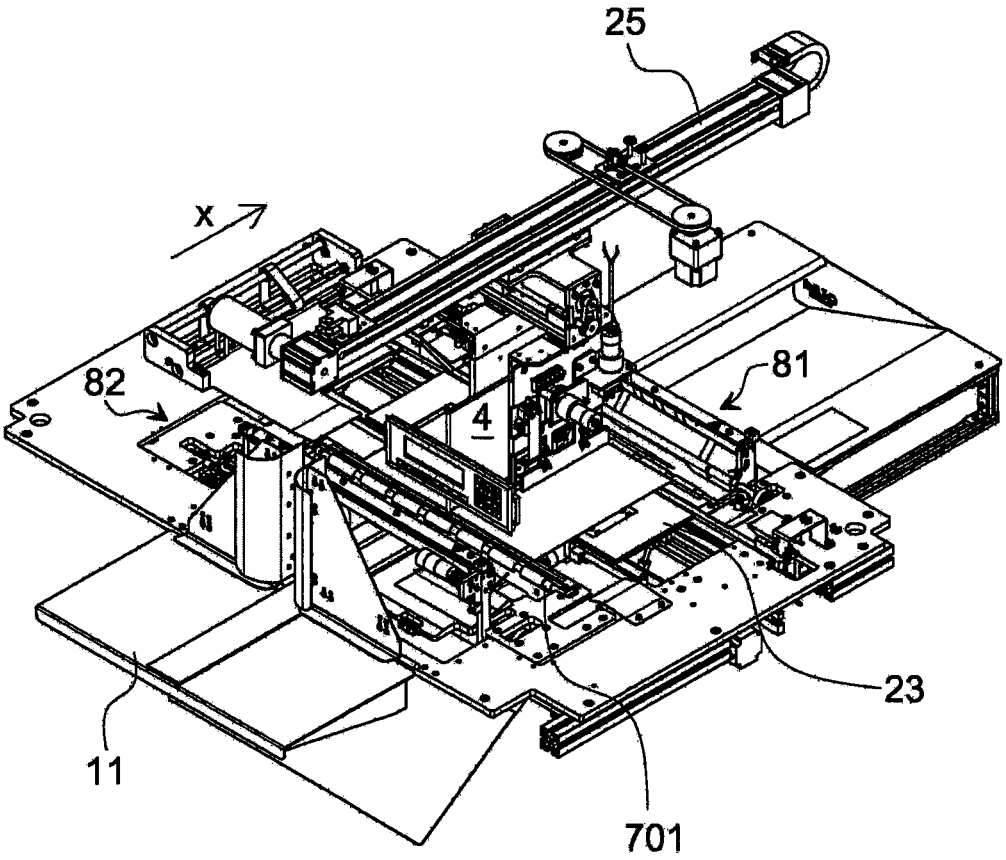
FIG. 21 is a partial perspective view of the automatic machine for covering books according to a further variant of the embodiment of the present invention.

According to a further variant of the embodiment of the present invention, in addition to the elements of the embodiment of the present invention or of the variant of the other variant, the automatic machine for covering books comprises a motorized roller 701 moved by suitable means and parallel to the cutting and welding blade 83, as shown in FIG. 21; the motorized roller 701 is arranged close to the welding blade 83 and on the lower part of book 1 when the book is arranged on the work plane 23. The rotation of the motorized roller 701 in descent step of the cutting and welding blade 83 allows the folded film sheet 5 to be pulled outwards to make the side ends 7 and 8 more adherent to the internal part of the covers 2, 3 of book 1; thereby, the internal bodies of the side ends 6 and 7 are reduced so as to make the side ends 7 and 8 folded on the internal part of the covers 2, 3 of book 1 more adherent to the internal part of the covers 2, 3 of book 1. The motorized roller is controlled by the control unit 100 before the cutting and welding blade 83 takes the work position T3, preferably when the cutting and welding blade 83 takes the intermediate rest position T2.

The invention claimed is:

1. An automatic machine for covering covers of a book of different length, width, and thickness dimensions starting from a film sheet, said machine comprising a work plane on which said film sheet is placed, said machine comprising cutting and welding means of the film sheet, first and second folding means of ends of the film sheet and a control unit configured to control said cutting and welding means and said first and second folding means as a function of book dimension for the covering operation of the book covers, wherein reception and gripping means are configured to receive said book, with the covers in open position, at an input position and configured to grip a body of the book outside a work plane and to transport the book at a working position over the film sheet for the covering operation of the book covers, said control unit being adapted to control said reception and gripping means, said control unit being configured to control said first and second folding means to fold the ends of the film sheet on the covers of the book, the book being covered automatically without intervention of an operator.

2. The machine according to claim 1, wherein said reception and gripping means of the book are configured to receive the book at the input position with the covers opened substantially at ninety degree with respect to the book body and are configured to arrange the book at the working position always with the covers opened substantially at ninety degree with respect to the book body.

3. The machine according to claim 1, wherein means configured to produce a film sheet from a film coil and a second means configured to arrange said film sheet on the work plane of the machine, said first means configured to produce a film sheet from a film coil and said second means configured to arrange said film sheet on the work plane of the machine being controlled by said control unit.

4. The machine according to claim 3, wherein said first means configured to produce a film sheet comprise further means configured to unwind said film coil, means for measuring the film sheet and means for cutting the film sheet, said second means configured to arrange said film sheet on the work plane of the machine comprise means for transporting the film sheet to the work plane and means configured to grip the film sheet and to arrange it on the work plane.

5. The machine according to claim 1, wherein said first and second folding means comprise flaps configured to rotate the ends of the film sheet on an internal part of the book covers.

6. The machine according to claim 5, wherein said flaps are shiftable to fit a width of the book before the rotation of the ends of the film sheet on the internal part of the book covers.

7. The machine according to claim 1, wherein said reception and gripping means comprise a reception and gripping element provided with first and second walls parallel to each other and spaced from each other, said first and second walls being configured to receive the book body between them.

8. The machine according to claim 7, wherein said reception and gripping element comprises a further wall perpendicular to first and second walls, said further wall being provided with a sensor that, when activated by the body of the book, controls the closing of the first and second walls on the body of the book to grip the body of the book.

9. The machine according to claim 8, wherein said reception and gripping element is configured to transport the book with the covers covered with the film sheet outside the work plane for discharging the book.

10. The machine according to claim 1, characterized in that said cutting and welding means comprise a first cutting and welding device which is not configured to determine and a second cutting and welding device which is configured to determine a length of the book.

11. The machine according to claim 10, wherein said first and second cutting and welding devices comprise respectively first and a second cutting and welding blades which are configured to rotate from a rest position to the work position for welding and cutting the film sheet on upper and lower sides of the book once that the ends of the film sheet have been folded on the covers of the book.

12. The machine according to claim 1, including a means for measuring a border of the book.

13. The machine according to claim 6, wherein said flaps, after the ends of the film sheet are rotated so the ends of the film sheet are adjacent to an internal part of the book covers, are configured to compensate the border of the book which is measured by a measure means.

14. The machine according to claim 7, wherein a measure means configured to measure the border of a book comprise a pair of sensors arranged on the first and second walls of the reception and gripping element, said first and second walls of the reception and gripping element being configured to lower the book covers when the book is placed in work position to allow the measure of the border of the book.

15. The machine according to claim 1, including a means to detect the length of the book, said means comprising sensors arranged on the frame of the machine and configured to detect the length of the book during passage of the book from the input position to the work position.

16. The machine according to claim 1, wherein gate means configured to prevent input of another book after passage of the book from the input position to the work position.

17. The machine according to claim 1, wherein means configured to detect width of the book, said means comprising sensors arranged on said first and second folding means and configured to detect the width of the book with the book at the work position.

18. The machine according to claim 7, wherein said reception and gripping element slides along a crosspiece for transporting the book from the input position to the work position on the work plane, said crosspiece being capable of rotating about a vertical axis.

19. The machine according to claim 7, wherein said reception and gripping means comprise fins provided with springs and configured to keep the body of the book in vertical position before it is gripped by said reception and gripping element.

20. The machine according to claim 1, wherein it comprises a motorized roller controlled by said control unit to pull the folded film sheet outwards to make side ends of the folded film sheet more adherent to an internal part of the covers of the book.

21. The machine according to claim 3, wherein it comprises further means for measuring a width of the book and in that said first means for producing a film sheet comprise means for unwinding the film coil and means for cutting the film sheet, said second means for arranging the film sheet on the work plane of the machine comprise means for transporting the film sheet to the work plane and means for gripping the film sheet and placing it on the work plane, said means for unwinding the film coil and said means for cutting the film sheet being controlled by said control unit as a function of the measurement taken by said further means for measuring a width of the book.

22. A method for applying covers to a book of different length, width, and thickness dimensions starting from a film sheet, said method comprising:

placing the film sheet on a work plane of an automatic machine, placing the book on the film sheet, folding the ends of the film sheet and welding and cutting it as a function of book dimension for the operation of covering the book covers, wherein after placing the film sheet on a work plane, receiving said book with the covers in open position at an input position, gripping a body of the book outside the work plane, transporting and placing the book at a working position over the film sheet, covering the covers of the book with said film sheet which comprises folding ends of the film sheet on the covers of the book, coordinating said steps of gripping, transporting and placing the book on the work plane, and said steps of folding the ends of the film sheet on the covers and of welding and cutting the film sheet as a function of the book dimension by means of a control unit, the book being covered automatically once placed on the film sheet without intervention of an operator.

23. The method according to claim 22, wherein before placing the film sheet on the work plane, producing the film sheet from a film coil and transporting the film sheet onto the work plane of the machine.

24. The method according to claim 22, wherein after placing the book at the work position over the film sheet, measuring a border of the book and compensating the border during the covering step of the book covers with said film sheet.

* * * * *